United States Patent [19]

Welker

[11] 4,251,074

[45] Feb. 17, 1981

[54] MINIATURE BASEBALL GAME CONSTRUCTION

[76] Inventor: Peter Welker, 882 Dickson Hill, Petaluma, Calif. 94952

[21] Appl. No.: 45,168

[22] Filed: Jun. 4, 1979

[51] Int. Cl.[3] ..... A63F 7/20

[52] U.S. Cl. ..... 273/89; 124/26

[58] Field of Search ..... 124/41 R, 37, 16, 26; 273/89, 26 B

[56] References Cited

U.S. PATENT DOCUMENTS

| | | | |
|---|---|---|---|
| 266,980 | 11/1882 | Easton | 124/41 R |
| 1,595,185 | 8/1926 | Granger et al. | 273/89 |
| 1,651,686 | 12/1927 | Fennessy | 273/89 |
| 3,232,285 | 2/1966 | Rasner | 124/37 X |
| 3,261,340 | 7/1966 | Laird | 124/41 R X |

*Primary Examiner*—George J. Marlo

*Attorney, Agent, or Firm*—Townsend and Townsend

[57] ABSTRACT

An improved pitching mechanism and ball construction for miniature baseball games of the table-top variety. A pitching arm protrudes through an opening in the playing surface at the pitcher's mound from below. A horizontal pin at the upper end of the pitching arm extends toward home plate and is formed for slidable mating engagement within a conforming bore in the ball which is constructed of a lightweight material such as balsa wood. The pitching arm is pivotally rotatable in a vertical arc to provide a range of angular ball release positions combining various amounts of elevation above the playing surface and horizontal distance from an imaginary line between the pitcher's mound and home plate. The pitching arm is retractable away from home plate against the action of a spring such that increasing amounts of retraction provide greater speed of the ball upon release. The ball moves with the pitching arm throughout its various movements prior to release of the pitching linkage by the player to provide increased control of the ball's trajectory in a manner simulating actual baseball pitching techniques.

8 Claims, 3 Drawing Figures

MINIATURE BASEBALL GAME CONSTRUCTION

BACKGROUND OF THE INVENTION

The present invention relates to miniature baseball games of the table-top variety and is more particularly directed to an improved pitching mechanism and ball construction for such a game which together provide a greater degree of player control of the ball trajectory during pitching.

Miniature baseball game of the table-top variety which utilize mechanical pitching and batting mechanisms have been available for some time. It is well-known that the success of such games depends to a large extent on the degree of player involvement in the game. This in turn is related to how closely the game can be made to duplicate the various aspects of a real baseball game. To this end, numerous attempts have been made to increase player involvement by employing mechanisms which allow greater control of the ball's trajectory during the pitching operation. The present invention achieves a greatly increased degree of pitching control with a relatively simple and easily constructed pitching mechanism and ball construction.

SUMMARY OF THE INVENTION

According to the present invention, the pitching linkage is designed so that the pitching arm which protrudes through the playing surface is pivotally rotatable in a vertical arc about a line between the pitcher's mound and home plate and the ball can be released from any position along this arc. This results in the pitcher's ability to control both the height of the ball's trajectory above the playing surface as well as the distance from home plate as the ball passes the batting mechanism.

In addition to the range of release positions in a vertical arc, the pitching arm is movable toward and away from the batter. Movement of the pitching arm away from the batter is opposed by a spring such that the further from the batter the release position is, the faster the speed of the ball upon release. By combining various angular release positions with varying amounts of retraction, the ball's trajectory may be varied to simulate a number of pitches commonly employed in actual baseball games, such as "low and outside", "high strike", "fastball", "sinker", and so on.

The pitching arm and the ball are formed for slidable mating engagement so that the ball moves with the pitching arm through all the various possible pre-release movements described above. This provides much better ball control than is possible using the more conventional approach of a stationary ball which is struck by a moving pitching mechanism. Finally, the ball is constructed of lightweight material for increased responsiveness to propelling forces extend on it by the pitching and batting mechanisms.

These and other objects, features and advantages of the present invention will be more readily apparent from a reading of the following detailed description with reference to the accompanying drawings.

DETAILED DESCRIPTION OF THE PREFERRED EMBODIMENT

Figure 1:
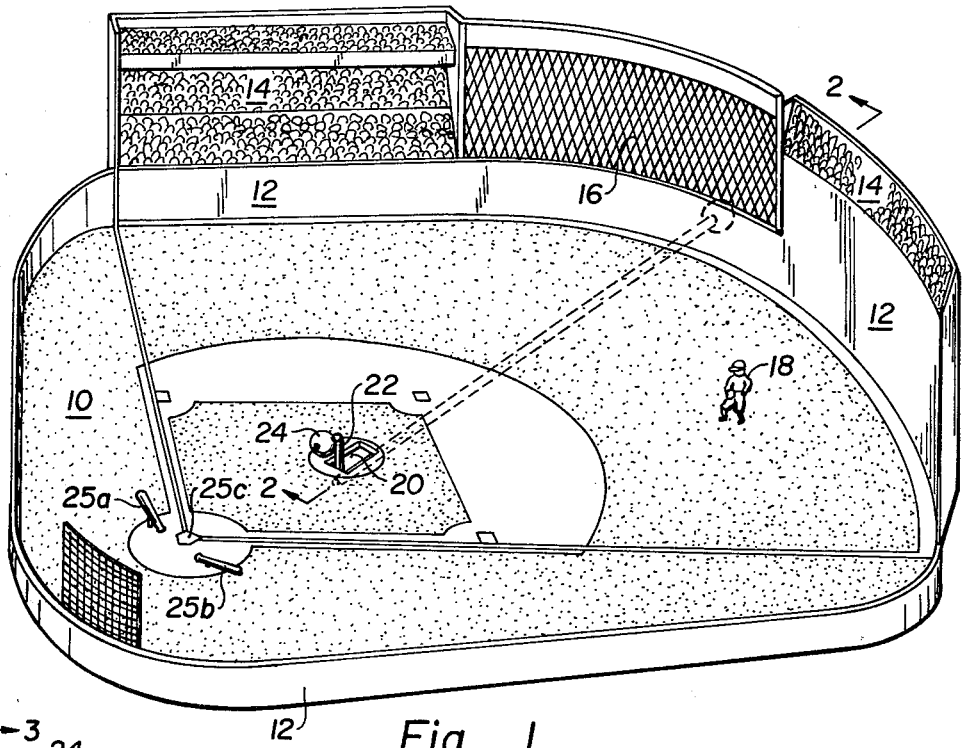
FIG. 1 is an overall perspective view of the miniature baseball game of the present invention.

Referring now to the drawings, a preferred embodiment of the miniature baseball game of the present invention is illustrated in FIG. 1 and includes a planar playing surface 10 with markings simulating the layout of an actual baseball field. A vertical wall 12 encircles the playing field and along the arc defined by the first and third baselines forms the outfield wall. Above the outfield wall are simulated bleachers 14 and scoreboard 16. Baseball player figures 18 can be positioned at suitable locations on the playing surface and are provided with markings simulating the uniforms of opposing baseball teams.

Rectangular aperture 20 is provided in the playing surface at the location of the pitcher's mound and pitching arm 22 which forms the end of the pitching mechanism to be described below protrudes through the aperture from beneath the playing surface. Ball 24 is carried on the end of arm 22 in a manner to be described. Batting mechanisms **25*a* and 25*b* are provided on either side of home plate 25*c***. These batting mechanisms are of conventional construction such as described in U.S. Pat. No. 2,559,872 issued July 10, 1951 to Grohman, et al.

Figure 2:
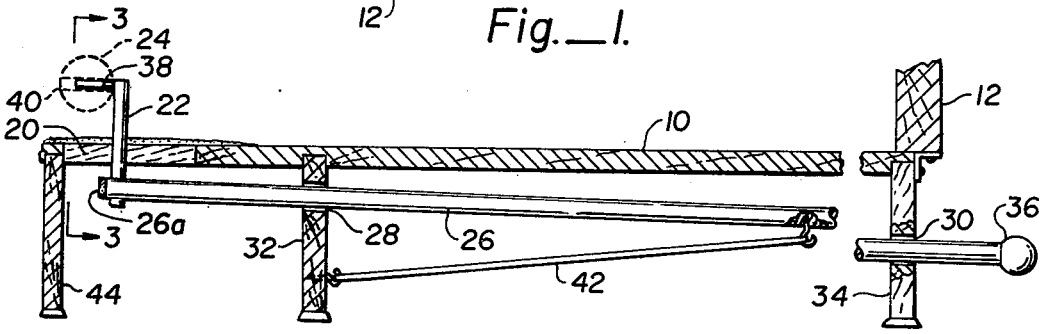
FIG. 2 is a cross-sectional side elevation taken along lines 2—2 of FIG. 1.
Figure 3:
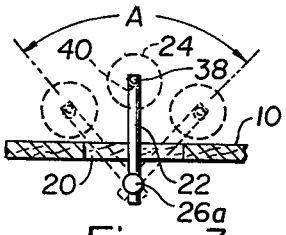
FIG. 3 is a cross-sectional front elevation taken along lines 3—3 of FIG. 2.

Referring now to FIGS. 2 and 3, the constructional details of the pitching mechanism will be described. The pitching linkage includes rod 26 which for example, may be a wooden dowel. Rod 26 slides reciprocally toward and away from home plate within apertures 28 and 30 respectively provided in vertical support members 32 and 34. The end of rod 26 which passes through aperture 30 projects beyond the outer side of outfield wall 12 and terminates in a knob 36. The other end of rod 26 terminates below aperture 20 and pitching arm 22 extends upwardly from the end of the rod through the aperture. Attached to the upper end of arm 22 is a horizontal pin 38 extending toward home plate. Ball 24 is preferably constructed of lightweight material such as balsa wood and is provided with a diametrical bore 40 extending either partially or completely through the ball. Pin 38 and bore 40 are sized for mating engagement such that when the ball is placed on the pin it will not readily fall off. Spring 42 is attached between vertical support member 32 and rod 26 such that the spring opposes movement of the rod away from home plate.

In operation, the player representing the team on the field grasps handle 36 and pulls rod 26 away from home plate against the action of spring 42. At the same time, the player rotates knob 36 either clockwise or counterclockwise through a desired amount of arc. This rotation is translated by rod 26 into corresponding pivotal movement of pin 22 (with the ball attached) along a vertical arc "A" (see FIG. 3). As mentioned above, this allows the ball to be released from a range of positions corresponding to various combinations of vertical elevation above the playing surface and horizontal distance from an imaginary line between the center of the pitcher's mound (aperture 20) and home plate. The player can control the force with which the ball is propelled from pin 38 and thus the speed of the pitch by varying the amount of retraction of knob 36.

When knob 36 is released, spring 42 propels rod 26 and arm 22 rapidly toward home plate until the leading end face of the rod **26*a* strikes vertical support 44. The forward inertia of the ball propels it off pin 38 and toward home plate in a trajectory determined by the speed of the ball and the angular position of arm 22**. Thus, by combining a particular amount of retraction with a particular amount of rotation, the player can simulate a wide variety of actual baseball pitching techniques as described above.

Because the ball is made of lightweight material, it is especially responsive to th propulsive forces exerted on it by the pitching and batting mechanisms. For example, if suitably pitched and hit, the ball will be propelled over the outfield wall into the bleachers or even out of the simulated ball park altogether.

While a preferred embodiment of the miniature baseball game of the present invention has been shown and described above, it will be readily apparent to those skilled in the art that various modifications of the disclosed construction may be made without departing from the spirit and scope of the invention as defined by the claims set forth below.

What is claimed is:

1. In a miniature baseball game of the type having a pitching arm at a pitcher's mound position and a batting arm at a home plate position, the improvement comprising:

(a) means mounting the pitching arm for continuously variable pivotal rotation under manual control in a vertical arc about a line between the pitcher's mound position and the home plate position;

(b) means mounting the ball on the pitching arm for movement therewith;

(c) means for rapidly moving the pitching arm toward the home plate position;

(d) means for rapidly terminating movement of the pitching arm toward the home plate position whereby the forward inertia of the ball toward the home plate position propels it off the ball mounting means and toward the home plate position in a trajectory determined at least in part by the speed of the pitching arm and the angular rotation of the pitching arm along said vertical arc.

2. The miniature baseball game of claim 1 wherein the ball mounting means further comprises a horizontal pin on the pitching arm extending in the direction of the home plate position and a bore in the ball sized for slidable mating engagement with the pin.

3. The miniature baseball game of claim 1 wherein the means mounting the pitching arm for pivotal rotation and the means for rapidly moving the pitching arm toward the home plate position further comprises:

(a) a rod mounted beneath the playing surface for slidable reciprocal motion toward and away from the home plate position;

(b) a spring connected to the rod and biasing it toward the homeplate position; and (c) a knob adapted for grasping by the hand of a player at an end of the rod projecting exteriorally of the playing surface.

4. The miniature baseball game of claim 1 wherein said means for terminating movement of the pitching arm further comprises a stop means adjacent the leading end of the rod.

5. In a miniature baseball game of the type having a spring-loaded mechanical pitching mechanism, the improvement comprising:

(a) a pitching arm extending upwardly through an aperture in the playing surface from below;

(b) means mounting the pitching arm for pivotal rotation in a vertical arc about a line between the pitching arm and a homeplate position;

(c) ball support means on the pitching arm;

(d) a ball having a bore therein formed for slidable mating engagement with the ball support means whereby the ball and pitching arm move together in a vertical arc.

6. The miniature baseball game of claim 5 wherein said ball support means comprises a horizontal pin attached to the pitching arm and extending toward the home plate position.

7. The miniature baseball game of claim 5 wherein said pitching arm mounting means further comprises:

(a) a rod mounted beneath the playing surface for slidable reciprocal movement toward and away from the home plate position, one end of the rod extending beyond the playing surface and the other end terminating below the aperture;

(b) spring means biasing the rod toward the home plate position;

(c) a knob on the end of the rod extending beyond the playing field; and (d) stop means adjacent the end of the rod below the aperture whereby rotation of the knob by a player results in pivotal movement of the arm and ball along a vertical arc and retraction of the knob against the spring followed by release causes the forward end of the rod to impact against the stop means propelling the ball toward the home plate position.

8. A miniature baseball game comprising:

(a) a planar playing surface having markings simulating a baseball field, said playing surface having an aperture at the location of the pitcher's position;

(b) a rod mounted beneath the playing surface for rotation about its longitudinal axis and slidable axial movement towards and away from the home plate position, said rod being spring-biased toward said home plate position and having one end projecting outwardly from beneath said playing surface and another end terminating beneath said aperture;

(c) a pitching arm attached to the end of the rod beneath the aperture and projecting upwardly therethrough;

(d) a horizontal pin on the end of said arm projecting above said playing surface and oriented toward the home plate position;

(e) a ball having a bore therein sized for slidable mating engagement with the pin; and (f) a knob at the end of the rod projecting beyond the playing surface whereby rotation of the knob by a player results in the pivotal rotation of the pin and ball along a vertical arc and release of the knob in a retracted position results in ejection of the ball from the pin in a trajectory determined at least in part both by the amount of rotation and the amount of retraction of the knob.

* * * * *